US010364980B2

(12) United States Patent
Colannino et al.

(10) Patent No.: US 10,364,980 B2
(45) Date of Patent: Jul. 30, 2019

(54) CONTROL OF COMBUSTION REACTION PHYSICAL EXTENT

(71) Applicant: ClearSign Combustion Corporation, Seattle, WA (US)

(72) Inventors: Joseph Colannino, Bellevue, WA (US); David B. Goodson, Bellevue, WA (US); Igor A. Krichtafovitch, Kirkland, WA (US); Tracy A. Prevo, Seattle, WA (US); Christopher A. Wiklof, Everett, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 519 days.

(21) Appl. No.: 15/073,986

(22) Filed: Mar. 18, 2016

(65) Prior Publication Data

US 2016/0273764 A1 Sep. 22, 2016

Related U.S. Application Data

(63) Continuation of application No. PCT/US2014/056928, filed on Sep. 23, 2014.
(Continued)

(51) Int. Cl.
*F23C 99/00* (2006.01)
*F23N 5/02* (2006.01)
(Continued)

(52) U.S. Cl.
CPC ..... *F23C 99/001* (2013.01); *F23N 5/022* (2013.01); *F23N 5/082* (2013.01); *F23N 5/123* (2013.01); *F23N 5/203* (2013.01); *F23N 2029/20* (2013.01)

(58) Field of Classification Search
CPC ..... F23N 5/022; F23N 5/082; F23N 5/123; F23N 5/203; F23N 2029/20; F23C 99/001
See application file for complete search history.

(56) References Cited

U.S. PATENT DOCUMENTS 2,604,936 A 7/1952 Kaehni et al.
2,942,420 A 6/1960 Clark
(Continued)

FOREIGN PATENT DOCUMENTS

EP 2738460 6/2014
FR 2577304 12/1989
(Continued)

OTHER PUBLICATIONS

PCT International Search Report and Written Opinion of International PCT Application No. PCT/US2014/056928 dated Jan. 19, 2015.
(Continued)

*Primary Examiner* — Alfred Basichas
(74) *Attorney, Agent, or Firm* — Christopher A. Wiklof; Nicholas S. Bromer; Launchpad IP, Inc.

(57) ABSTRACT

Technologies are described for applying electrical energy according to a physical extent of a combustion reaction, which may include: supporting a combustion reaction at a fuel source; sensing a physical extent of the combustion reaction with respect to a plurality of different locations of a plurality of electrodes; and applying electrical energy to the combustion reaction via at least one of the plurality of electrodes responsive to the physical extent of the combustion reaction. Sensing the physical extent of the combustion reaction may include receiving a sensor signal corresponding to the physical extent of the combustion reaction.

38 Claims, 7 Drawing Sheets

Related U.S. Application Data

(60) Provisional application No. 61/881,420, filed on Sep. 23, 2013.

(51) Int. Cl.

| | |
|---|---|
| ***F23N 5/08*** | (2006.01) |
| ***F23N 5/12*** | (2006.01) |
| ***F23N 5/20*** | (2006.01) |

(56) References Cited

U.S. PATENT DOCUMENTS

| | | | |
|---|---|---|---|
| 3,004,137 | A | 10/1961 | Karlovitz |
| 3,087,472 | A | 4/1963 | Yukichi |
| 3,167,109 | A | 1/1965 | Wobig |
| 3,224,485 | A | 12/1965 | Blomgren, Sr. et al. |
| 3,301,307 | A | 1/1967 | Nishigaki et al. |
| 3,306,338 | A | 2/1967 | Wright et al. |
| 3,373,306 | A | 3/1968 | Karlovitz |
| 3,416,870 | A | 12/1968 | Wright |
| 4,091,779 | A | 5/1978 | Suafferer et al. |
| 4,111,636 | A | 9/1978 | Goldberg |
| 5,702,244 | A | 12/1997 | Goodson et al. |
| 5,784,889 | A | 7/1998 | Joos et al. |
| 7,137,808 | B2 | 11/2006 | Branston et al. |
| 7,159,646 | B2 | 1/2007 | Dessiatoun et al. |
| 7,523,603 | B2 | 4/2009 | Hagen et al. |
| 7,845,937 | B2 | 12/2010 | Hammer et al. |
| 8,082,725 | B2 | 12/2011 | Younsi et al. |
| 8,851,882 | B2 | 10/2014 | Hartwick et al. |
| 8,881,535 | B2 | 11/2014 | Hartwick et al. |
| 8,911,699 | B2 | 12/2014 | Colannino et al. |
| 9,062,882 | B2 | 6/2015 | Hangauer et al. |
| 9,151,549 | B2 | 10/2015 | Goodson et al. |
| 9,209,654 | B2 | 12/2015 | Colannino et al. |
| 9,243,800 | B2 | 1/2016 | Goodson et al. |
| 9,267,680 | B2 | 2/2016 | Goodson et al. |
| 9,284,886 | B2 | 3/2016 | Breidenthal et al. |
| 9,289,780 | B2 | 3/2016 | Goodson |
| 9,310,077 | B2 | 4/2016 | Breidenthal et al. |
| 9,366,427 | B2 | 6/2016 | Sonnichsen et al. |
| 9,371,994 | B2 | 6/2016 | Goodson et al. |
| 9,377,188 | B2 | 6/2016 | Ruiz et al. |
| 9,377,189 | B2 | 6/2016 | Ruiz et al. |
| 9,377,190 | B2 | 6/2016 | Karkow et al. |
| 9,377,195 | B2 | 6/2016 | Goodson et al. |
| 9,388,981 | B2 | 7/2016 | Karkow et al. |
| 2003/0003590 | A1 | 1/2003 | Abbasi et al. |
| 2005/0208442 | A1 | 9/2005 | Heiligers et al. |
| 2005/0208446 | A1 | 9/2005 | Jayne |
| 2006/0165555 | A1 | 7/2006 | Spielman et al. |
| 2007/0020567 | A1 | 1/2007 | Branston et al. |
| 2010/0183424 | A1 | 7/2010 | Roy |
| 2011/0085030 | A1 | 4/2011 | Poe et al. |
| 2012/0156628 | A1 | 6/2012 | Lochschmied et al. |
| 2012/0276487 | A1 | 11/2012 | Hangauer et al. |
| 2013/0071794 | A1 | 3/2013 | Colannino et al. |
| 2013/0230810 | A1 | 9/2013 | Goodson et al. |
| 2013/0260321 | A1 | 10/2013 | Colannino et al. |
| 2013/0323655 | A1 | 12/2013 | Krichtafovitch et al. |
| 2013/0323661 | A1 | 12/2013 | Goodson et al. |
| 2013/0333279 | A1 | 12/2013 | Osler et al. |
| 2013/0336352 | A1 | 12/2013 | Colannino et al. |
| 2014/0051030 | A1 | 2/2014 | Colannino et al. |
| 2014/0065558 | A1 | 3/2014 | Colannino et al. |
| 2014/0076212 | A1 | 3/2014 | Goodson et al. |
| 2014/0080070 | A1 | 3/2014 | Krichtafovitch et al. |
| 2014/0162195 | A1 | 6/2014 | Lee et al. |
| 2014/0162196 | A1 | 6/2014 | Krichtafovitch et al. |
| 2014/0162197 | A1 | 6/2014 | Krichtafovitch et al. |
| 2014/0162198 | A1 | 6/2014 | Krichtafovitch et al. |
| 2014/0170569 | A1 | 6/2014 | Anderson et al. |
| 2014/0170571 | A1 | 6/2014 | Casasanta, III et al. |
| 2014/0170575 | A1 | 6/2014 | Krichtafovitch |
| 2014/0170576 | A1 | 6/2014 | Colannino et al. |
| 2014/0170577 | A1 | 6/2014 | Colannino et al. |
| 2014/0186778 | A1 | 7/2014 | Colannino et al. |
| 2014/0196368 | A1 | 7/2014 | Wiklof |
| 2014/0196369 | A1 | 7/2014 | Wiklof |
| 2014/0208758 | A1 | 7/2014 | Breidenthal et al. |
| 2014/0212820 | A1 | 7/2014 | Colannino et al. |
| 2014/0216401 | A1 | 8/2014 | Colannino et al. |
| 2014/0227645 | A1 | 8/2014 | Krichtafovitch et al. |
| 2014/0227646 | A1 | 8/2014 | Krichtafovitch et al. |
| 2014/0227649 | A1 | 8/2014 | Krichtafovitch et al. |
| 2014/0248566 | A1 | 9/2014 | Krichtafovitch et al. |
| 2014/0255855 | A1 | 9/2014 | Krichtafovitch |
| 2014/0255856 | A1 | 9/2014 | Colannino et al. |
| 2014/0272730 | A1 | 9/2014 | Krichtafovitch et al. |
| 2014/0272731 | A1 | 9/2014 | Breidenthal et al. |
| 2014/0287368 | A1 | 9/2014 | Krichtafovitch et al. |
| 2014/0295094 | A1 | 10/2014 | Casasanta, III |
| 2014/0295360 | A1 | 10/2014 | Wiklof |
| 2014/0335460 | A1 | 11/2014 | Wiklof et al. |
| 2015/0079524 | A1 | 3/2015 | Colannino et al. |
| 2015/0104748 | A1 | 4/2015 | Dumas et al. |
| 2015/0107260 | A1 | 4/2015 | Colannino et al. |
| 2015/0121890 | A1 | 5/2015 | Colannino et al. |
| 2015/0140498 | A1 | 5/2015 | Colannino |
| 2015/0147704 | A1 | 5/2015 | Krichtafovitch et al. |
| 2015/0147705 | A1 | 5/2015 | Colannino et al. |
| 2015/0147706 | A1 | 5/2015 | Krichtafovitch et al. |
| 2015/0219333 | A1 | 8/2015 | Colannino et al. |
| 2015/0226424 | A1 | 8/2015 | Breidenthal et al. |
| 2015/0241057 | A1 | 8/2015 | Krichtafovitch et al. |
| 2015/0276211 | A1 | 10/2015 | Colannino et al. |
| 2015/0276217 | A1 | 10/2015 | Karkow et al. |
| 2015/0276220 | A1 | 10/2015 | Karkow et al. |
| 2015/0285491 | A1 | 10/2015 | Karkow et al. |
| 2015/0316261 | A1 | 11/2015 | Karkow et al. |
| 2015/0330625 | A1 | 11/2015 | Karkow et al. |
| 2015/0338089 | A1 | 11/2015 | Krichtafovitch et al. |
| 2015/0345780 | A1 | 12/2015 | Krichtafovitch |
| 2015/0345781 | A1 | 12/2015 | Krichtafovitch et al. |
| 2015/0362177 | A1 | 12/2015 | Krichtafovitch et al. |
| 2015/0362178 | A1 | 12/2015 | Karkow et al. |
| 2015/0369476 | A1 | 12/2015 | Wiklof |
| 2015/0369477 | A1 | 12/2015 | Karkow et al. |
| 2016/0003471 | A1 | 1/2016 | Karkow et al. |
| 2016/0018103 | A1 | 1/2016 | Karkow et al. |
| 2016/0025333 | A1 | 1/2016 | Karkow et al. |
| 2016/0025374 | A1 | 1/2016 | Karkow et al. |
| 2016/0025380 | A1 | 1/2016 | Karkow et al. |
| 2016/0033125 | A1 | 2/2016 | Krichtafovitch et al. |
| 2016/0040872 | A1 | 2/2016 | Colannino et al. |
| 2016/0046524 | A1 | 2/2016 | Colannino et al. |
| 2016/0047542 | A1 | 2/2016 | Wiklof et al. |
| 2016/0091200 | A1 | 3/2016 | Colannino et al. |
| 2016/0123576 | A1 | 5/2016 | Colannino et al. |
| 2016/0138800 | A1 | 5/2016 | Anderson et al. |
| 2016/0161110 | A1 | 6/2016 | Krichtafovitch et al. |
| 2016/0161115 | A1 | 6/2016 | Krichtafovitch et al. |
| 2016/0175851 | A1 | 6/2016 | Colannino et al. |

FOREIGN PATENT DOCUMENTS

| | | |
|---|---|---|
| GB | 932955 | 7/1963 |
| GB | 1042014 | 9/1966 |
| JP | 58-019609 | 2/1983 |
| JP | 60-216111 | 10/1985 |
| JP | 61-265404 | 11/1986 |
| JP | H 07-48136 | 2/1995 |
| JP | 2001-021110 | 1/2001 |
| WO | WO 1996/001394 | 1/1996 |
| WO | WO 2004/015333 | 2/2004 |
| WO | WO 2013/181569 | 12/2013 |
| WO | WO 2015/042614 | 3/2015 |
| WO | WO 2015/042615 | 3/2015 |
| WO | WO 2015/051136 | 4/2015 |
| WO | WO 2015/051377 | 4/2015 |
| WO | WO 2015/054323 | 4/2015 |
| WO | WO 2015/057740 | 4/2015 |
| WO | WO 2015/061760 | 4/2015 |
| WO | WO 2015/070188 | 5/2015 |
| WO | WO 2015/089306 | 6/2015 |

(56) References Cited

FOREIGN PATENT DOCUMENTS

| | | |
|---|---|---|
| WO | WO 2015/103436 | 7/2015 |
| WO | WO 2015/112950 | 7/2015 |
| WO | WO 2015/123149 | 8/2015 |
| WO | WO 2015/123381 | 8/2015 |
| WO | WO 2015/123670 | 8/2015 |
| WO | WO 2015/123683 | 8/2015 |
| WO | WO 2015/123694 | 8/2015 |
| WO | WO 2015/123696 | 8/2015 |
| WO | WO 2015/123701 | 8/2015 |
| WO | WO 2016/003883 | 1/2016 |
| WO | WO 2016/007564 | 1/2016 |
| WO | WO 2016/018610 | 2/2016 |

OTHER PUBLICATIONS

PCT International Search Report and Written Opinion of International PCT Application No. PCT/US2014/060534 dated Jan. 19, 2015.

B. Stratton et al., "Determining Flame Height and Flame Pulsation Frequency and Estimating Heat Release Rate from 3D Flame Reconstruction." Fire Engineering Research Report 05/2, Dept. of Civil Engineering, Univ. of Canterbury, Christchurch, New Zealand, Jul. 2005, 90 pages.

CONTROL OF COMBUSTION REACTION PHYSICAL EXTENT

CROSS REFERENCE TO RELATED APPLICATIONS

The present application is a U.S. Continuation Application which claims priority benefit under 35 U.S.C. § 120 (pre-AIA) of co-pending International Patent Application No. PCT/US2014/056928, entitled "CONTROL OF COMBUSTION REACTION PHYSICAL EXTENT," filed Sep. 23, 2014; which application claims priority benefit U.S. Provisional Patent Application No. 61/881,420, entitled "CONTROL OF COMBUSTION REACTION PHYSICAL EXTENT," filed Sep. 23, 2013, each of which, to the extent not inconsistent with the disclosure herein, is incorporated by reference.

SUMMARY

One embodiment is a system configured to apply electrical energy to a combustion reaction responsive to or to control a physical extent of the combustion reaction. The system may include a plurality of electrodes configured to apply electrical energy to a combustion reaction at a fuel source. Each of the plurality of electrodes may have a location with respect to the combustion reaction. The system may include an electrical power supply including a plurality of outputs. Each of the plurality of electrodes may be operatively coupled to at least one of the plurality of outputs. The system may include a controller configured together with the electrical power supply and the plurality of electrodes to apply electrical energy to the combustion reaction. The controller may apply electrical energy to the combustion reaction responsive to a physical extent of the combustion reaction with respect to the location of at least one of the plurality of electrodes.

One embodiment is a method for applying electrical energy according to a physical extent of a combustion reaction. The method may include supporting a combustion reaction at a fuel source. The method may include sensing a physical extent of the combustion reaction with respect to a plurality of different locations of a plurality of electrodes. The method may include applying electrical energy to the combustion reaction via at least one of the plurality of electrodes responsive to the physical extent of the combustion reaction. Sensing the physical extent of the combustion reaction may include receiving a sensor signal corresponding to the physical extent of the combustion reaction.

DETAILED DESCRIPTION

Figure 1:
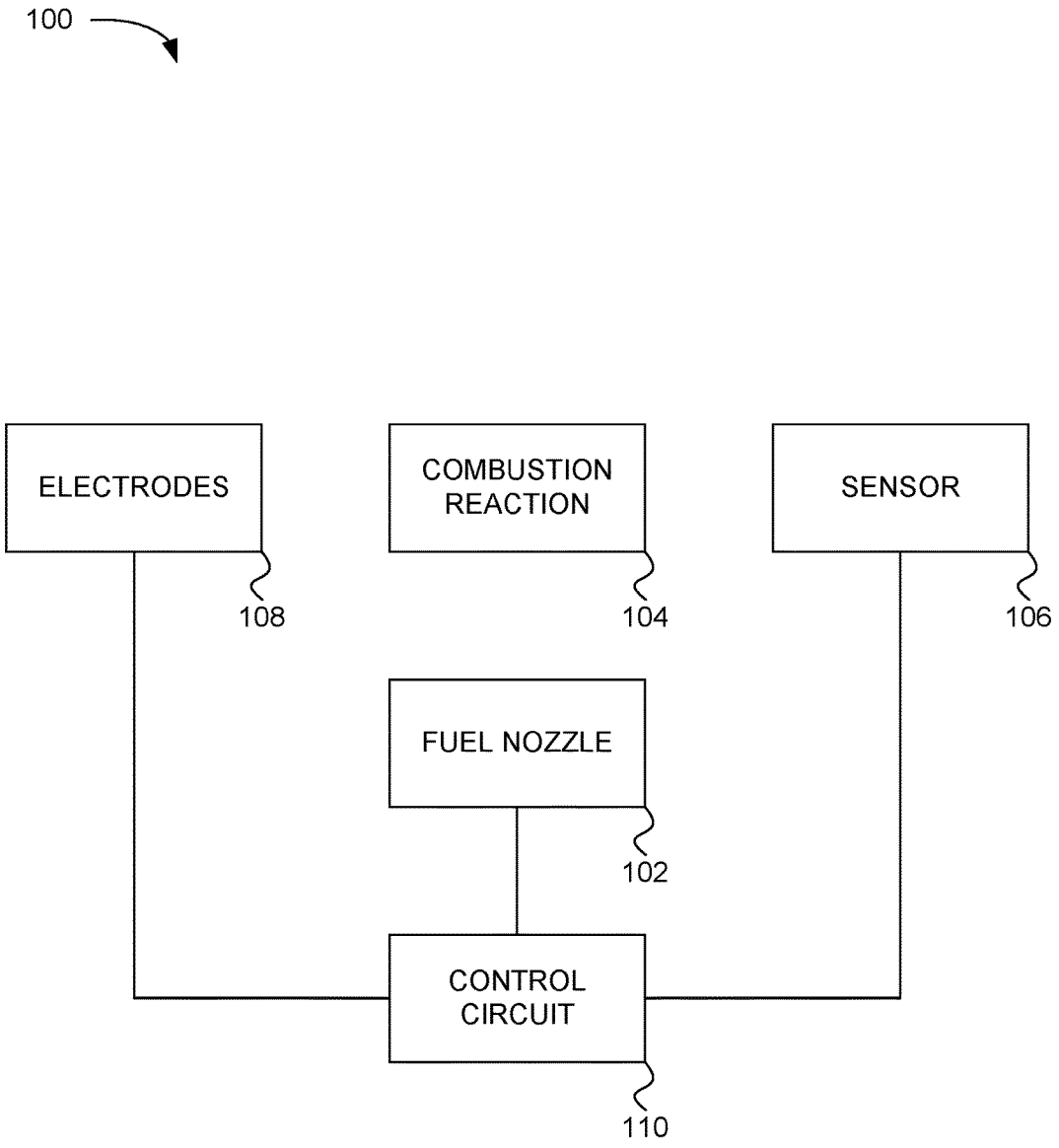
FIG. 1 is a block diagram of a system for applying electrical energy to a combustion reaction, according to one embodiment.

In the following detailed description, reference is made to the accompanying drawings, which form a part hereof. In the drawings, similar symbols typically identify similar components, unless context dictates otherwise. Other embodiments may be used and/or other changes may be made without departing from the spirit or scope of the disclosure.

FIG. 1 is a block diagram of a combustion system 100, according to one embodiment. The combustion system 100 includes a fuel nozzle 102 configured to initiate and sustain a combustion reaction 104. A sensor 106 is positioned adjacent to the combustion reactions 104. A plurality of electrodes 108 are also positioned adjacent to the combustion reaction 104. A control circuit 110 is coupled to the fuel nozzle 102 the sensor 106 and the electrodes 108.

The fuel nozzle 102 is configured to output fuel for the combustion reaction 104 upon receiving a command from the control circuit 110. Upon receiving the command from the control circuit 110, the fuel nozzle 102 outputs fuel from the fuel nozzle 102 and ignites the fuel to initiate the combustion reaction 104.

The fuel nozzle 102 can output both fuel and an oxygen source such as air into a combustion chamber in which the combustion reaction 104 takes place. Alternatively, the fuel nozzle 102 outputs only fuel while a separate nozzle outputs a source of oxygen for the combustion reaction 104. The fuel nozzle 102 can include multiple nozzles that output fuel and multiple nozzles that output and oxygen source.

The electrodes 108 are positioned adjacent the combustion reaction 104. In one embodiment, the combustion reaction 104 extends vertically and the electrodes 108 are each positioned a respective distance from the fuel nozzle in the vertical direction. The electrodes 108 can therefore be arranged in a vertical line adjacent to the combustion reaction. Alternatively, electrodes 108 can be positioned on different sides of the combustion reaction 104 and at different heights.

In one embodiment, the electrodes 108 can be separated laterally from the combustion reaction 104 by a small dielectric gap. In particular, a dielectric gas such as air or flue gas can separate the electrodes 108 from the combustion reaction 104. Alternatively, one or more of the electrodes can be positioned within the combustion reaction 104.

The electrodes 108 can each exert an electrical influence on the combustion reaction 104 in order to modify one or more parameters of the combustion reaction 104 such as flame length, flame temperature, flame color, the completeness of the combustion of the fuel, etc. For example, the control circuit 110 can apply respective voltages to the electrodes 108. In this manner, one or more of the electrodes 108 can generate an electric field that will influence the combustion reaction 104, can act as a source of charged particles for the flame, or can otherwise influence the combustion reaction 104.

In order to enable increased precision in influencing the combustion reaction 104, the sensor 106 is positioned adjacent to the combustion reaction 104. In one embodiment, the sensor 106 senses the length of the combustion reaction 104 and transmits to the control circuit 110 a signal indicative of the length of the combustion reaction 104. Alternatively, the sensor 106 can sense another parameter of the combustion reaction 104.

When the control circuit 110 receives the signal from the sensor 106, the control circuit 110 can adjust the respective voltages applied to the electrodes 108. For example, if the sensor 106 indicates that the combustion reaction 104 is comparatively short in length, then the control circuit 102 can increase the voltage on one of the electrodes 108 closest to the combustion reaction 104. At the same time, the control circuit 110 can reduce the magnitude of the voltage applied to one or more of the electrodes 108 that are further from the fuel nozzle 102 than the length of the combustion reaction. Alternatively, the control circuit 110 can completely remove respective voltages from one or more of the electrodes 108 most distant from the fuel nozzle 102.

If the sensor 106 indicates that the combustion reaction 104 extends beyond one or more of the electrodes 108 closest to the fuel nozzle 102, then the control circuit 110 can reduce the magnitude of respective voltages applied to one or more of the electrodes 108 closest to the fuel nozzle 102. Control circuit 110 can also increase the magnitude of the voltage of one or more of the electrodes 108 that are near the end of the combustion reactions 104.

In one embodiment, the control circuit 110 can apply respective voltages to one or more of the electrodes 108 that are near a center of the combustion reaction 104 as indicated by the sensor 106. At the same time, the control circuit 110 can reduce or remove voltages applied to one or more of the electrodes 108 that are relatively far from a center of the combustion reaction 104.

In one embodiment, the control circuit 110 can apply or increase the respective voltages to all the electrodes 108 that are within a distance from the fuel nozzle 102 corresponding to the length of the combustion reaction 104 or a selected portion of the length of the reaction 104. The control circuit 110 can also reduce or remove respective voltages applied to those electrodes 108 that are further from the fuel nozzle 102 than the length of the combustion reaction 104.

Electrodes 108 can also be used to help control the length of the combustion reaction 104. For example by applying a high-voltage to a selected one or more of the electrodes 108, the length of the combustion reaction 104 can be extended or reduced to a position corresponding to the selected one or more electrodes 108.

In a particular application, it may be desirable that the combustion reaction 104 has a particular length. If the sensor 106 indicates that the length of the combustion reaction 104 is currently shorter than the desired length of the combustion reaction 104, then the control circuit 110 can increase a magnitude of the voltage applied to one or more of the electrodes whose position corresponds to the desired reaction length in order to draw the combustion reaction 104 to the desired length. At the same time, the control circuit 12 can decrease a magnitude of the voltage applied to one or more the electrodes 108 whose position is near to the fuel nozzle 102 than the desired length of the combustion reaction 104.

Alternatively, if the sensor 106 indicates that the length of the combustion reaction 104 is currently longer than the desired length of the combustion reaction 104, then the control circuit 110 can increase a magnitude of the voltage applied to one or more of the electrodes 108 whose positions correspond to the desired length of the combustion reaction in order to draw the combustion reaction 104 down to the desired length. At the same time, the control circuit 110 can reduce the magnitude of the voltage applied to one or more of the electrodes 108 that are positioned further from the fuel nozzle 102 than the desired length of the combustion reaction 104. The control circuit 110 can also apply a voltage of opposite polarity (with respect to the polarity of the voltage applied to those electrodes whose positions correspond to the desired length of the combustion reaction 104) to those electrodes 108 whose positions are farther from the fuel nozzle 102 than the desired length of the combustion reaction 104 in order to shorten the combustion reaction 104 by repelling the combustion reaction 104 from those electrodes 108 whose position is farther from the fuel nozzle 102 than the desired length of the combustion reaction 104.

While various examples have been given above regarding altering the respective voltages applied to the electrodes 108 based on the length of the combustion reaction 104, those of skill in the art will recognize, in light of the present disclosure, that the respective voltages can be altered in many ways other than those described above in order to influence the combustion reaction 104. Likewise, those of skill in the art will recognize that the control circuit 110 can alter the voltages applied to the electrodes 108 based on parameters other than the length of the combustion reaction 104. All such other schemes for applying voltages to the electrodes 108 and all such other combustion reaction parameters based on which the control circuit 110 alters the voltages fall within the scope of the present disclosure.

In one embodiment, the system 100 includes an input terminal (not shown in FIG. 1) coupled to the control circuit. An operator of the control system can view of the combustion reaction 104 and can adjust the respective voltages applied to the electrodes 108 in order to control the length or another parameter of the combustion reaction 104. In one example, the combustion system 100 includes a window by which the user can see the combustion reaction 104. Alternatively, the system 100 can include an image sensor and a display each coupled to the control circuit. The image sensor can capture an image or video of the combustion reaction 104 and then display can display the image or video of the combustion reaction 104. The operator can view the image or video of the combustion reaction 104 on the display and can use the input terminal to manually adjust the voltages applied to the electrodes 108 in order to adjust the length or other parameter of the combustion reaction 104.

Figure 2:
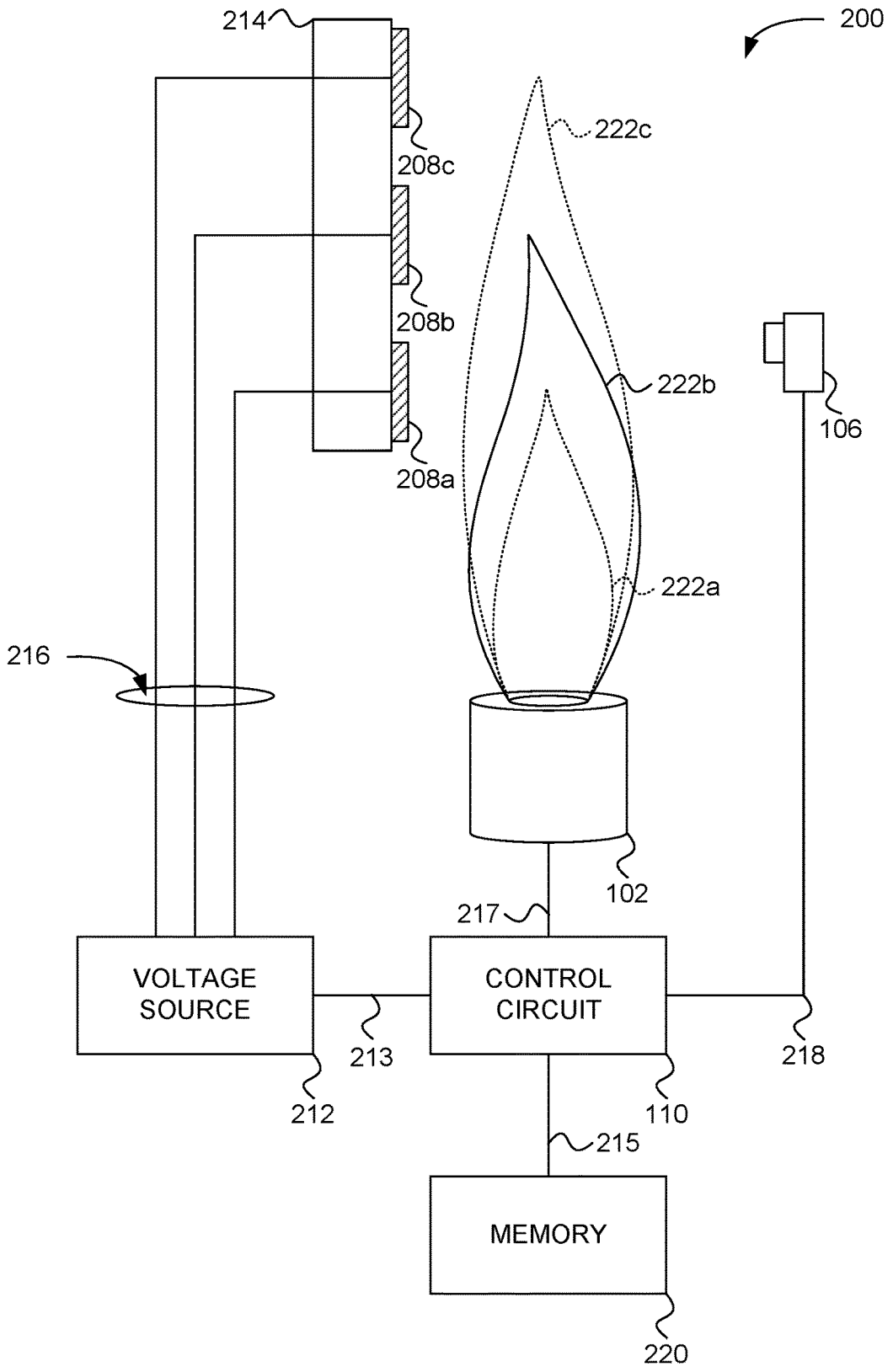
FIG. 2 is an illustration of a system including multiple electrodes for applying electrical energy to a combustion reaction, according to one embodiment.

FIG. 2 is an illustration of a combustion system 200, according to one embodiment. The combustion system 200 includes a fuel nozzle 102 configured to sustain a combustion reaction 104. A sensor 106 is positioned adjacent to the combustion reaction 104. Three electrodes 208A, 208B, and 208C are positioned adjacent the combustion reaction 104 opposite from the sensor 106 and fixed to a support 214. Each of the electrodes 208A-208C are connected to a voltage source 212 by wires 216. The control circuit 110 is coupled to the voltage source 212 by one or more wires 213, to the sensor 106 by one or more wires 218, to the fuel nozzle 102 by one or more wires 217, and to a memory 220 by one or more wires 215.

In FIG. 2, the combustion reaction 104 has a length corresponding to position 222B. Some of the other possible lengths of the combustion reaction 104 correspond to positions 222A and 222C shown in dashed lines. Position 222A corresponds generally to a vertical position of the electrode 208A. Position 222B corresponds generally to a vertical position of the electrode 208B. Position 222C corresponds generally to a vertical position of the electrode 208C. The length of the combustion reaction 104 is not limited to those positions shown in FIG. 2.

In one embodiment, the sensor 106 senses the length of the combustion reaction 104. The sensor 106 then transmits a sensor signal to the control circuit 110 via the wire 218. The sensor signal is indicative of the length of the combustion reaction 104.

Upon receiving the sensor signal from the sensor 106, the control circuit 110 can adjust the respective voltages applied to the electrodes 208A-208C by the voltage source 212. The control circuit 110 can adjust the voltages applied to the electrodes 208A-208C in order to produce a desired characteristic in the combustion reaction 104. In one embodiment, the control circuit 110 can adjust the voltages applied to the electrodes 208A-208C to change the length of the combustion reaction 104 to a particular position. Alternatively, the control circuit 110 can adjust the voltages applied to the electrodes 208A-208C in order to more effectively apply electrical influence to the combustion reaction 104 based on the detected length. The voltage source 212 can apply a voltage to the fuel nozzle 102 in order to impart a voltage to the combustion reaction 104, thereby enabling the electrodes 208A-C to influence the combustion reaction in a desired manner by application of selected voltages to the electrodes from the voltage source 212.

In one embodiment, the control circuit 110 is configured to maintain the length of the combustion reaction 104 at a particular position selected by a user and/or stored in the memory 220. In one example the control circuit 110 is configured to maintain a length of the combustion reaction 104 at a position corresponding to position 222A. If the sensor signal indicates that the combustion reaction 104 has a length corresponding to position 222B, than the control circuit 110 can increase a magnitude of the voltage applied to the electrode 208A and decrease a magnitude of the voltages (or remove the voltage entirely) applied to the electrodes 208B, 208C. Alternatively, the control circuit 110 can apply to one or both of the electrodes 208B, 208C a voltage having a polarity opposite to that applied to the electrode 208A in order to repel the combustion reaction 104 from the electrodes 208B, 208C thereby shortening the combustion reaction 104.

In another example, the control circuit 110 is configured to maintain a length of the combustion reaction 104 at a position corresponding to position 222B. If the sensor signal indicates that the combustion reaction 104 has a length corresponding to position 222A or to position 222C, then the control circuit 110 can increase a magnitude of the voltage applied to the electrode 208B and decrease a magnitude of the voltages (or remove the voltages entirely) applied to the electrodes 208A, 208C.

In one embodiment, the control circuit 110 is configured to apply voltages to the electrodes 208A-208C based on the detected length of the combustion reaction 104 in order to energize one or more of the electrodes 208A-C having a position suitable to influence the combustion reaction 104. For example, if the sensor signal indicates that the combustion reaction 104 extends to the position 222C, the control circuit 110 can apply a voltage to the electrode 208C in order to influence the combustion reaction 104. Likewise, if the sensor signal indicates that the combustion reaction 104 extends to the position 222A, the control circuit 110 can apply a voltage to the electrode 208A in order to influence the combustion reaction 104. The control circuit 110 can also reduce or disconnect voltages applied to electrodes that are not in a position to influence the combustion reaction 104 and a desired manner.

The respective voltages applied to the electrodes 208A-C from the voltage source 212 can include DC voltages or periodic voltage waveforms such as sinusoidal voltages, sawtooth voltages, triangular voltages, square wave voltages etc. The periodic voltage waveforms may have a frequency between 50 and 1500 Hz. Additionally or alternatively, the frequency of the periodic waveforms may be between 200 and 800 Hz. The voltage source 212 may be configured to apply periodic voltage waveforms having peak-to-peak values between 1 kV and 80 kV.

In one embodiment, the sensor 106 may not be present. Instead, one or more of the electrodes 208A-208C can act as a sensor in combination with the control circuit 110. In particular, the control circuit 110 is configured to sense the length of the combustion reaction 104 based on a variation in electrical energy at the combustion reaction 104 via one or more of the electrodes 208A-C. One or more of the plurality of electrodes 208A-C may be configured as a corona electrode and the control circuit 110 may be further configured to sense the physical extent of the combustion reaction 104 according to a short at the corona electrode. The control circuit 110 may be further configured to de-energize the corona electrode responsive to the short at the corona electrode. One or more of the plurality of electrodes 208A-C may be configured as a field electrode and the control circuit 110 may be further configured to detect a change in a back electromotive force at the field electrode. The control circuit 110 may be further configured to cause a change in electrical energy applied to the field electrode responsive to the back electromotive force at the field electrode. The control circuit 110 may be further configured to control the length of the combustion reaction via a feedback loop that takes into account changes in electrical energy applied to the field electrode and the back electromotive force at the field electrode.

In one embodiment, the plurality of electrodes 208A-C may include the first electrode 208A configured as a charge electrode. The first electrode 208A may be configured as the charge electrode to impart a combustion reaction voltage or a combustion reaction voltage majority charge to the combustion reaction voltage. The plurality of electrodes 208A-C may include at least one field electrode, e.g., the second electrode 208B, located further from the fuel source compared to the electrode 208A. The at least one field electrode may be configured to attract the combustion reaction 104 based on the respective voltages applied to the electrode 208B and the combustion reaction 104.

In one embodiment, the first electrode 208A and the second electrode 208B may be configured to cooperate to increase or decrease the physical extent of the combustion reaction 104. The plurality of electrodes 208A-C may include two or more of the field electrodes configured as a plurality of ladder electrodes. For example, the electrodes 208B, 208C may be configured as ladder electrodes located further from the fuel nozzle 102 than the electrode 208A. The ladder electrodes 208B, 208C may be configured to increase or decrease the physical extent of the combustion reaction 104 to the positions 2228, 222C respectively.

In one embodiment, the voltage source 212 may be configured to apply a DC voltage or constant sign charges to the first electrode 208A. The voltage source 212 may be configured to apply a time-varying voltage or time-varying charge signs to the electrode 208A. The voltage source 212 may be configured to apply a periodic voltage waveform to the electrode 208B. The periodic voltage waveform may have a frequency between 50 and 1500 Hz. Additionally or alternatively, the frequency of the periodic waveform may be between 200 and 800 Hz. The voltage source 212 may be configured to apply a periodic voltage waveform having a voltage between 1 kV and 80 kV to the electrode 208A. The respective voltages applied to the electrodes 208A-C can include DC voltages, periodic voltages such as sinusoidal voltages, sawtooth voltages, triangular voltages, square wave voltages etc. The periodic voltage waveform may have a frequency between 50 and 1500 Hz. Additionally or alternatively, the frequency of the periodic waveform may be between 200 and 800 Hz. The voltage source 212 may be configured to apply periodic voltage waveforms having peak-to-peak values between 1 kV and 80 kV.

In an embodiment, the voltage source 212 may be configured to apply a voltage waveform to the first electrode 208A. The voltage waveform may include one or more of the following waveforms. The voltage waveform may include a sinusoidal waveform. The voltage waveform may include a square waveform. The voltage waveform may include a sawtooth waveform. The voltage waveform may include a triangular waveform. The voltage waveform may include a logarithmic waveform. The voltage waveform may include an exponential waveform. The voltage waveform may include a truncated waveform of any of the preceding waveforms. The voltage waveform may include a combination of any two or more of the preceding waveforms.

In an embodiment, the control circuit 110 may include a sensing circuit configured to sense current flow between the electrode 208A and the field electrode 208B. The control circuit 110 may include one or more of voltage control logic, waveform duty cycle logic, waveform shape logic, or waveform frequency logic operatively coupled to the sensing circuit and configured to control one or more of voltage, waveform duty cycle, waveform shape, or waveform frequency responsive to the sensed current flow.

In one embodiment, one or more of the plurality of electrodes 208A-C may be operatively coupled to the fuel nozzle 102.

While the foregoing description has described the application of voltages to the electrodes 208A-C in order to impart electrical energy to the combustion reaction 104, electrical energy may be applied in the form of a charge, voltage, or electric field.

Figure 3:
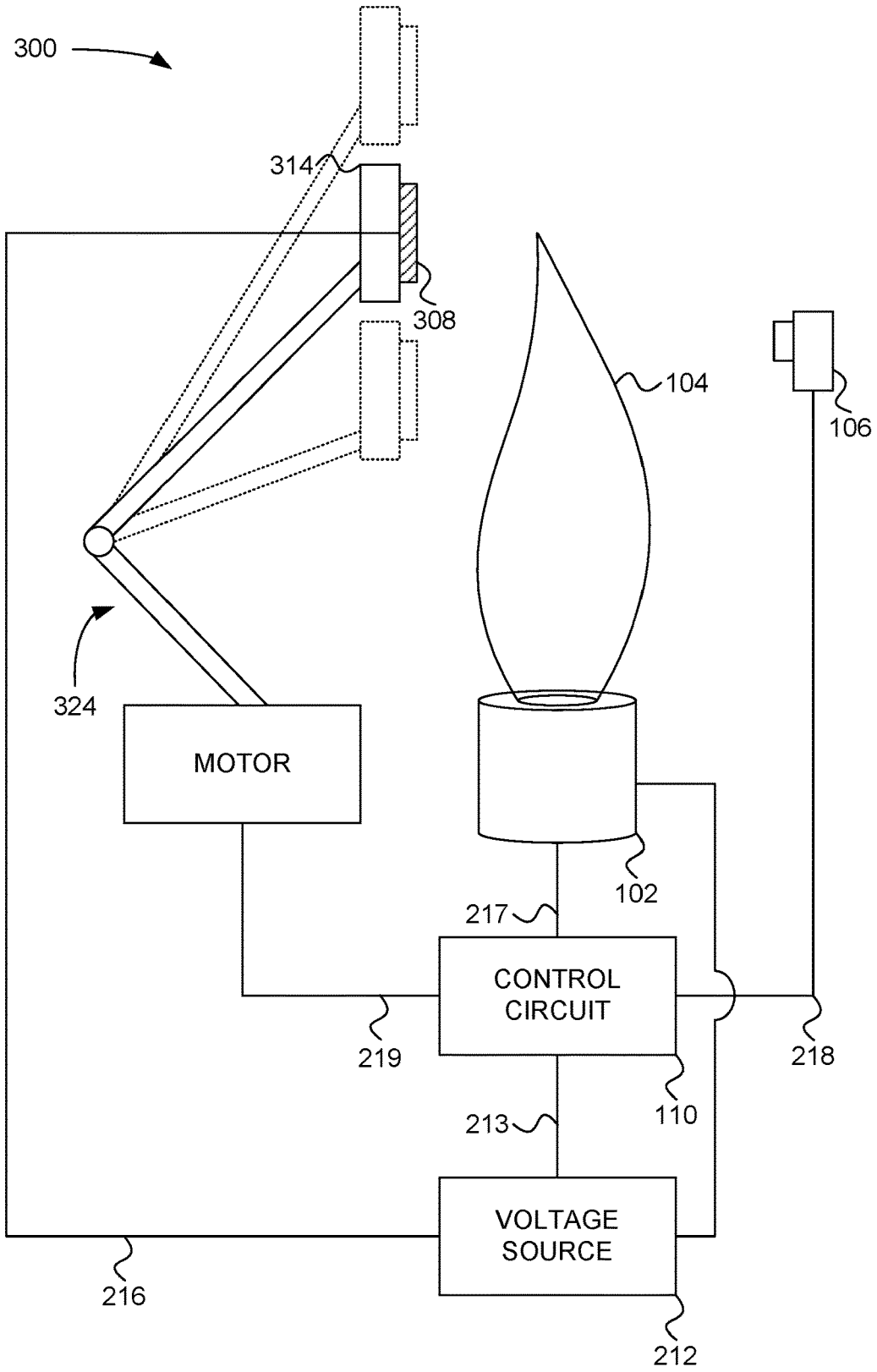
FIG. 3 is an illustration of a system including a movable electrode for applying electrical energy to a combustion reaction, according to one embodiment.

FIG. 3 is an illustration of a combustion system of 300, according to one embodiment. The combustion system 300 includes a fuel nozzle 102 configured to sustain a combustion reaction 104. A sensor 106 is positioned adjacent to the combustion reaction 104. A mobile electrode 308 is positioned adjacent to the combustion reaction 104 and fixed to a support 314. The mobile electrode 308 is coupled to a voltage source 212 by one or more wires 216. The support 314 is coupled to a motor 324. A control circuit 110 is coupled to the voltage source 212 by one or more wires 213, to the sensor 106 by one or more wires 218, to the fuel nozzle 102 by one or more wires 217, and to the motor 324 by one or more wires 219.

The sensor 106 measures a length of the combustion reaction 104 and transmits a sensor signal to the control circuit 110. The sensor signal is indicative of the length of the combustion reaction 104.

The control circuit 110 is configured to adjust a position of the electrode 308 in order to enable the electrode 308 to exert an electrical influence on the combustion reaction 104. In particular, the control circuit 110 receives the sensor signal from the sensor 106. The control circuit 110 computes a current length of the combustion reaction 104 based on the sensor signal. Based on the current length of the combustion reaction, the control circuit 110 adjusts the position of the electrode 308 by sending a control signal to the motor 324. Upon receiving the control signal, the motor 324 adjust the position of the electrode 308 so that electrode 308 can exert a desired influence on the combustion reaction 104. The control circuit 110 also controls the voltage source 212 to apply a voltage to the electrode 308 by which the electrode can influence the combustion reaction 104.

In one example, the sensor 106 detects that the length of the combustion reaction 104 is shorter than a vertical distance between the fuel nozzle 102 and the electrode 308. In response, the control circuit 110 causes the motor 324 to lower the electrode 308 to a position closer to the combustion reaction 104. Alternatively, if the sensor 106 detects that the combustion reaction 104 extends beyond current position of the electrode 308, then the control circuit 110 can cause the motor to raise the electrode 308 to a position adjacent to a particular portion of the combustion reaction 104. Upon adjusting the position of the electrode 308, the control circuit 110 can also cause the voltage source 212 to apply (or maintain) a particular voltage to the electrode 308 in order to electrically influence the combustion reaction 104.

In one embodiment, the control circuit 110 can adjust the position of and the voltage on the electrode 308 in order to control the length of the combustion reaction 104. For example, the control circuit 110 can be configured to maintain a selected length of the combustion reaction 104. In order to cause the combustion reaction 104 to have the selected length, the control circuit 110 can adjust the position of the electrode 308 to correspond to the selected length of the combustion reaction 104. The control circuit 110 can then cause the voltage source to 12 to apply a particular voltage to the electrode 308. The combustion reaction 104 is thus drawn to a length corresponding to the position of the electrode 308. In this manner, the control circuit 110 can increase or decrease the length of the combustion reaction according to instructions stored in the memory or input by an operator of the combustion system 300.

In one embodiment, the fuel nozzle 102 is electrically conductive. In order to facilitate controlling a characteristic of the combustion reaction 104, the voltage source 212 can apply a selected voltage to the fuel nozzle 102, thereby imparting the selected voltage to the combustion reaction 104. The respective voltages between the combustion reaction 104 and the electrode 308 allow the control circuit to control the combustion reaction 104 the desired manner.

Figure 4:
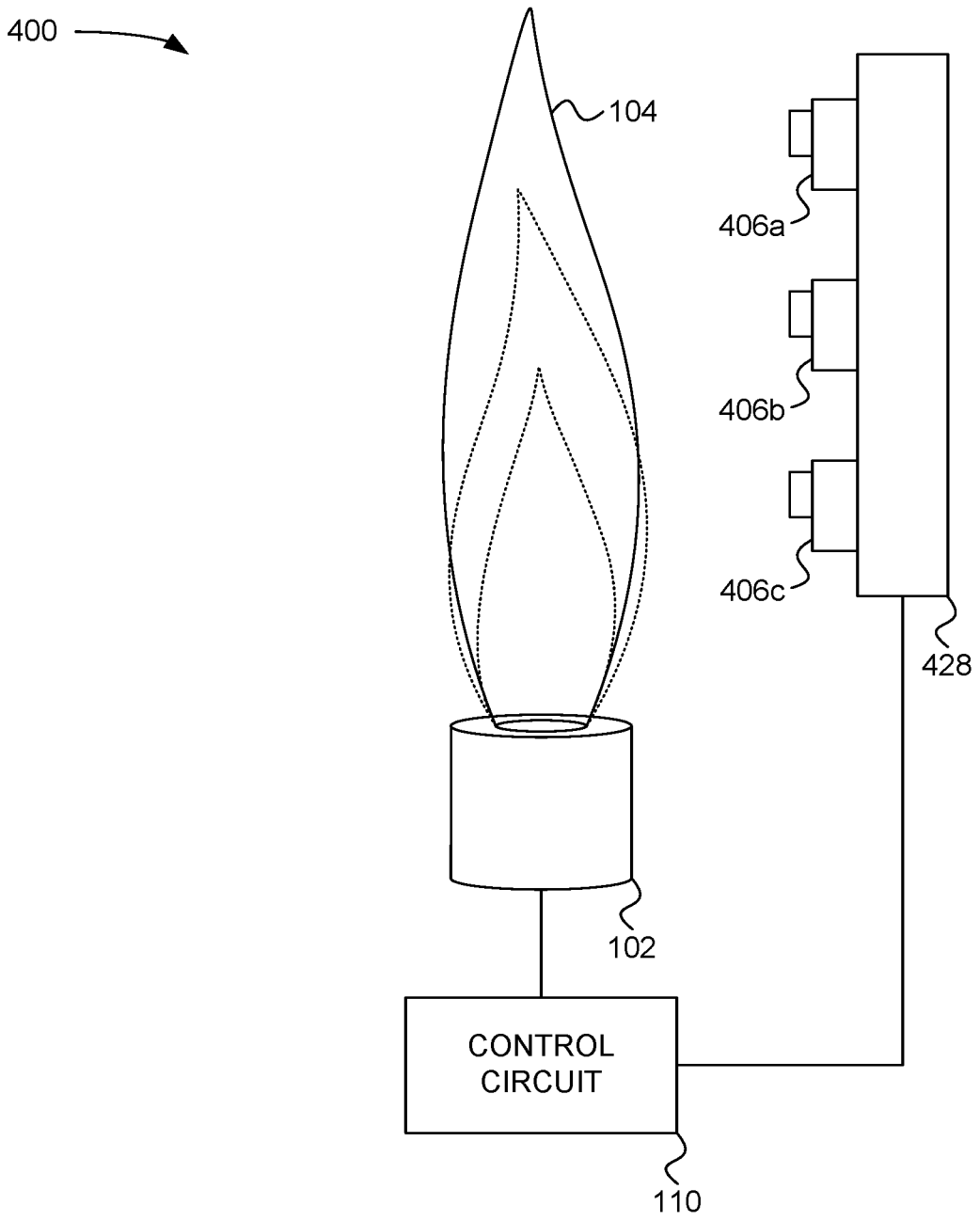
FIG. 4 illustrates a system including a plurality of sensors for measuring the length of a combustion reaction, according to one embodiment.

FIG. 4 is a diagram of a combustion system 400, according to one embodiment. The combustion system 400 includes a fuel nozzle 102 configured to maintain a combustion reaction 104. A plurality of sensors 406A-C are coupled to a sensor support 428. A control circuit 110 is coupled to the fuel nozzle 102 and the sensors 406A-C. Though not shown in FIG. 4, the combustion system 400 can also include electrodes configured to exert electrical influence on the combustion reaction 104 as described above.

In one embodiment, the sensors 406A-C continuously or periodically measure the length of the combustion reaction 104 and transmit a sensor signal, or a plurality of sensor signals, to the control circuit 110. The sensor signal is indicative of the length of the combustion reaction 104.

The sensors 406A-C are collectively configured to measure the length of the combustion reaction 104. The presence of multiple sensors 406A-C can allow for a more accurate measurements of the length of the combustion reaction 104. This is because the sensors 406A-C are arranged at different vertical distances from the fuel nozzle 102 and therefore can make measurements at different distances from the fuel nozzle 102.

The sensors 406A-C can be temperature sensors, light sensors, infrared sensors, ultraviolet sensors, capacitive sensors, or any other sensors suitable to measure a length of the combustion reaction 104.

As described previously, the control circuit 110 receives the sensor signal and controls one or more electrodes to exert a selected influence over the combustion reaction 104.

Figure 5:
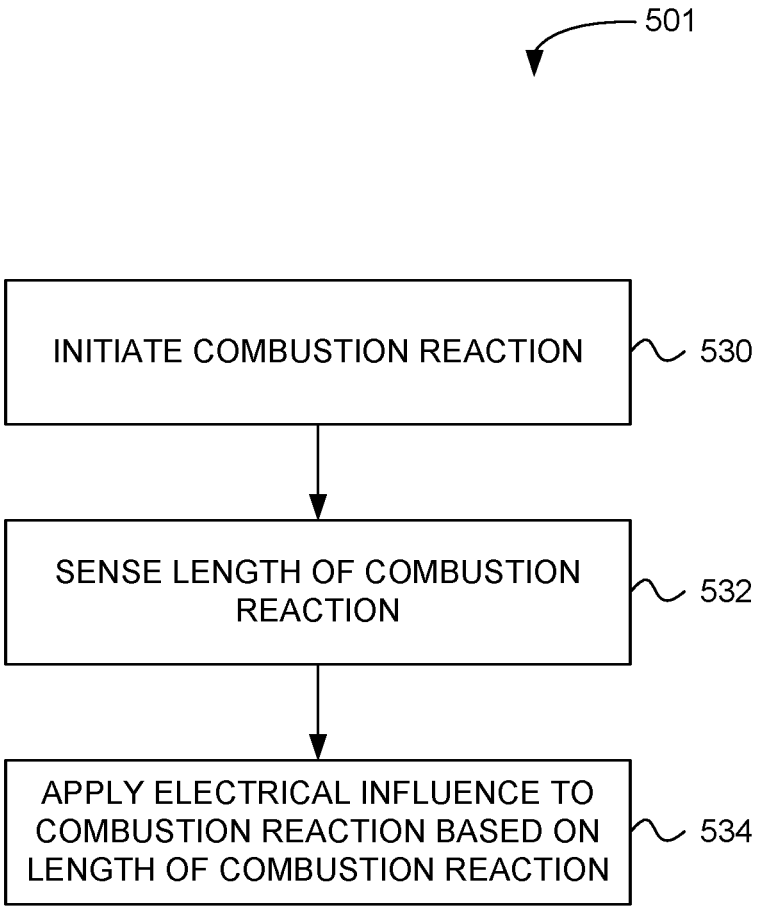
FIG. 5 is a flow chart of a process for applying electrical energy to a flame, according to one embodiment.

FIG. 5 is a flow diagram of a process 501 for operating a combustion system, according to one embodiment. At 530, a combustion reaction is initiated and maintained. This can include emitting fuel from a fuel nozzle and combusting the fuel with oxygen from an oxygen source. Alternatively, solid fuel can be used for the combustion reaction.

At 532 a sensor senses the length of the combustion reaction. The sensor can then transmit a signal to the control circuit indicating the length of the combustion reaction. The length of the combustion reaction can correspond to a distance from a fuel source to an end of the combustion reaction.

At 534, the control circuit can cause an electrode to apply electrical influence to the combustion reaction based on the length of the combustion reaction. For example, the combustion reaction can energize an electrode whose position corresponds to the position of the combustion reaction in response to receiving the signal from the sensor. The control circuit can also de-energize one or more other electrodes not in a position to influence the combustion reaction in the selected manner. In this way, the combustion reaction can be controlled to have particular characteristics such as a particular length, a particular temperature, a particular color, or to achieve a more complete combustion of the fuel.

Figure 6:
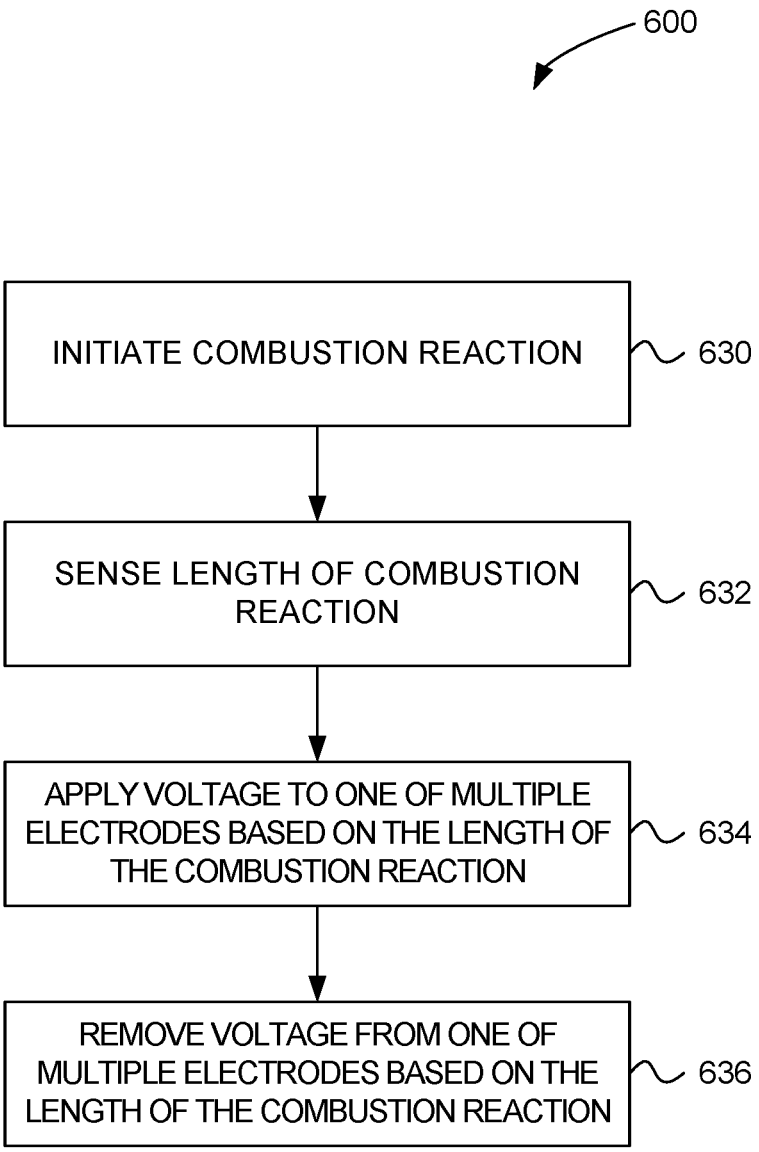
FIG. 6 is a flowchart of a process for applying electrical energy from multiple electrodes to a combustion reaction, according to one embodiment.

FIG. 6 is a flow diagram of a process 601 for operating a combustion system, according to one embodiment. At 630, a combustion reaction is initiated and maintained. This can include emitting fuel from a fuel nozzle and combusting the fuel with oxygen from an oxygen source. Alternatively, solid fuel can be used for the combustion reaction.

At 632 a sensor senses the length of the combustion reaction. The sensor can then transmit a signal to the control circuit indicating the length of the combustion reaction. The length of the combustion reaction can correspond to a distance from a fuel source to an end of the combustion reaction.

At 634, the control circuit can apply voltage to one or more of a plurality of electrodes adjacent the combustion reaction. For example, the combustion reaction can apply selected voltage to one or more of the plurality of electrodes whose positions correspond to the position of the combustion reaction in response to receiving the signal from the sensor.

At 636, the control circuit can reduce or remove a voltage from one or more of the electrodes not in a position to influence the combustion reaction in the selected manner. In this way, the combustion reaction can be controlled to have particular characteristics such as a particular length, a particular temperature, a particular color, or to achieve a more complete combustion of the fuel.

Figure 7:
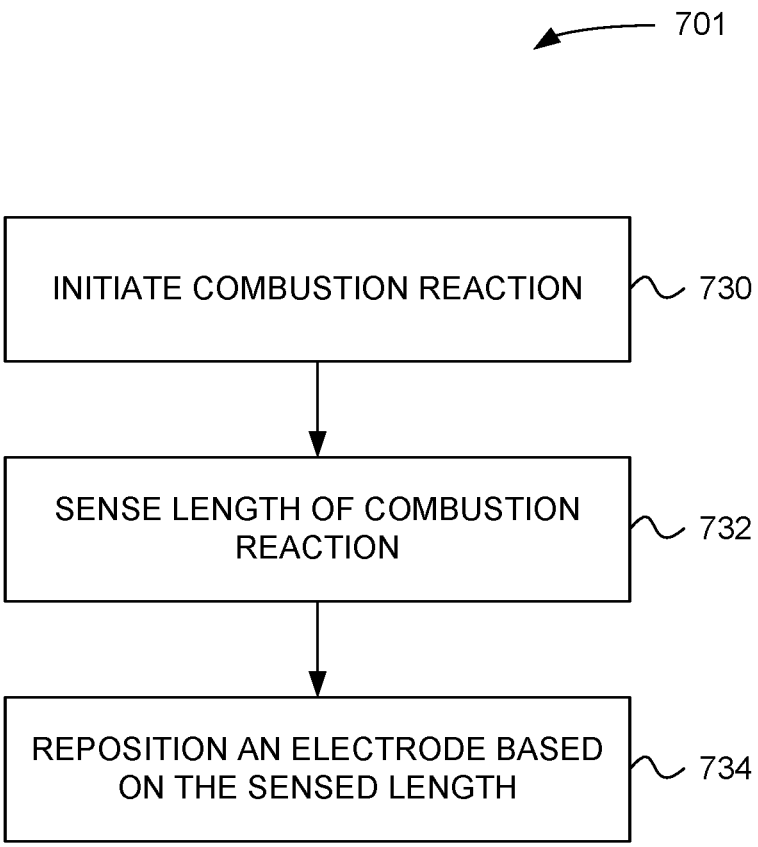
FIG. 7 is a flowchart of a process for applying electrical energy from a movable electrode to a combustion reaction, according to one embodiment.

FIG. 7 is a flow diagram of a process 701 for operating a combustion system, according to one embodiment. At 730, a combustion reaction is initiated and maintained. This can include emitting fuel from a fuel nozzle and combusting the fuel with oxygen from an oxygen source. Alternatively, solid fuel can be used for the combustion reaction.

At 732 a sensor senses the length of the combustion reaction. The sensor can then transmit a signal to the control circuit indicating the length of the combustion reaction. The length of the combustion reaction can correspond to a distance from a fuel source to an end of the combustion reaction.

At 734, the control circuit repositions an electrode to a position selected according to the measured length of the combustion reaction. The control circuit can then apply a voltage or other electrical signal to the electrode in order to electrically influence the combustion reaction in a selected manner.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A system comprising:

a fuel nozzle configured to output fuel for a combustion reaction;

a first electrode positioned adjacent the fuel nozzle;

a second electrode positioned adjacent the first electrode;

a control circuit configured to apply a first voltage signal to the first electrode and a second voltage signal to the second electrode; and a sensor positioned adjacent the fuel nozzle and configured to sense a length of the combustion reaction and to output a sensor signal indicative of the length, wherein the control circuit is configured to receive the sensor signal from the sensor and to apply, based on the sensor signal, the first voltage signal to the first electrode and the second voltage signal to the second electrode.

2. The system of claim 1, wherein the first electrode is closer to the fuel nozzle than the second electrode.

3. The system of claim 2, wherein the control circuit increases a magnitude of the second voltage signal if the sensor signal indicates that the combustion reaction extends beyond the first electrode.

4. The system of claim 3, wherein the control circuit removes the first voltage signal from the first electrode if the sensor signal indicates the combustion reaction extends beyond the first electrode.

5. The system of claim 3, wherein the control circuit decreases a magnitude of the first voltage signal if the sensor signal indicates that the combustion reaction extends beyond the second electrode.

6. The system of claim 2, wherein the control circuit increases a magnitude of the first voltage signal, and decreases a magnitude of the second voltage signal, if the sensor signal indicates that the length of the flame no longer extends beyond the first electrode.

7. The system of claim 1, comprising a memory coupled to the control circuit.

8. The system of claim 7, wherein the control circuit is configured to receive the sensor signal, to compare the sensor signal to data stored in the memory, and to alter the first and second voltage signals based on the comparison of the sensor signal and the data stored in the memory.

9. The system of claim 8, wherein the control circuit is configured to execute an algorithm stored in the memory and to alter the first and second voltage signals based on a result of the algorithm.

10. The system of claim 1, comprising a voltage supply coupled to the control circuit and the first and second electrodes, wherein the control circuit is configured to apply the first and second voltage signals by controlling the voltage supply.

11. The system of claim 1, wherein the control circuit is configured to cause the combustion reaction to extend to a position corresponding to the first electrode by applying the first voltage signal to the first electrode.

12. The system of claim 11, wherein the control circuit is configured to cause the combustion reaction to extend to a position corresponding to the second electrode by applying the second voltage signal to the second electrode.

13. The system of claim 1, wherein the control circuit is configured to apply a third voltage signal to the fuel nozzle.

14. The system of claim 13, wherein the third voltage signal is ground.

15. The system of claim 1, wherein the first voltage signal is a periodic voltage signal.

16. The system of claim 15, wherein the second voltage signal is a periodic voltage signal.

17. The system of claim 15, wherein the first voltage signal has a frequency between 50 and 1500 Hz.

18. The system of claim 15, wherein the first voltage signal has a peak-to-peak magnitude between 1 kV and 80 kV.

19. The system of claim 1, comprising an electrode support structure positioned adjacent the fuel nozzle, the first and second electrodes being positioned on the electrode support structure.

20. The system of claim 1, comprising a third electrode positioned adjacent the second electrode and farther from the fuel nozzle than the second electrode, the second electrode being positioned farther from the fuel nozzle than the first electrode.

21. The system of claim 1, wherein the control circuit is configured to receive input from an operator of the system and to adjust the first and the second voltage signals based on the input received from the first and second voltage signals.

22. The system of claim 21, comprising an input terminal coupled to the control circuit, the input terminal configured to receive input from the operator and to pass the input to the control circuit.

23. The system of claim 21 comprising:

an image sensor coupled to the control circuit and configured to capture an image of the combustion reaction; and a display coupled to the control circuit and configured to display the image of the combustion reaction.

24. A method comprising:

emitting fuel from a fuel nozzle;

sustaining a combustion reaction of the fuel;

applying a first voltage signal to a first electrode positioned adjacent to the combustion reaction;

applying a second voltage signal to a second electrode positioned adjacent to the combustion reaction;

altering the first and second voltage signals based on a parameter of the combustion reaction; and sensing a length of the combustion reaction with a sensor positioned adjacent to the combustion reaction.

25. The method of claim 24 comprising:

passing a sensor signal from the sensor to a control circuit coupled to the sensor and to the first and second electrodes, the sensor signal being indicative of the length of the combustion reaction; and applying or altering the first and second voltage signals by passing a control signal from the control circuit to a high voltage source coupled to the first and second electrodes.

26. The method of claim 25, wherein the second electrode is closer to the fuel nozzle than the first electrode.

27. The method of claim 26, comprising reducing a magnitude or removing the first voltage signal if the sensor signal indicates that the combustion reaction does not extend beyond the first electrode.

28. The method of claim 26, comprising applying the second voltage signal if the sensor signal indicates that the combustion reaction does not extend beyond the first electrode.

29. The method of claim 25, wherein the first electrode is closer to the fuel nozzle than the second electrode.

30. The method of claim 29, comprising reducing a magnitude or removing the first voltage signal if the sensor signal indicates that the combustion reaction extends beyond the first electrode.

31. The method of claim 29, comprising applying the second voltage signal if the sensor signal indicates that the combustion reaction extends beyond the first electrode.

32. The method of claim 24, comprising causing the combustion reaction to extend to a position corresponding to the first electrode by applying the first voltage signal to the first electrode.

33. The method of claim 32, comprising causing the combustion reaction to extend to a position corresponding to the second electrode by applying the second voltage signal to the second electrode.

34. The method of claim 24, comprising applying a third voltage signal to the fuel nozzle.

35. The method of claim 34, wherein the third voltage signal is ground.

36. The method of claim 24, comprising positioning an electrode support structure adjacent the fuel nozzle, the first and second electrodes being fixed to the electrode support structure.

37. The method of claim 24, comprising separating the first and second electrodes from the combustion reaction by a dielectric gap.

38. The method of claim 24, comprising adjusting the first and second voltage signals based on input received from a user.

* * * * *